United States Patent [19]

Kron et al.

[11] 4,398,678

[45] Aug. 16, 1983

[54] VARIABLE-WIDTH WEB SLITTING AND WINDING APPARATUS

[75] Inventors: Martin W. Kron; Victor I. Polz, both of Rochester, N.Y.

[73] Assignee: Eastman Kodak Company, Rochester, N.Y.

[21] Appl. No.: 258,833

[22] Filed: Apr. 29, 1981

[51] Int. Cl.[3] ..... B65H 35/02; B65H 17/08

[52] U.S. Cl. ..... 242/56.3; 242/56.4; 242/56.9; 242/65

[58] Field of Search ..... 242/56.3, 56.2, 56.4, 242/56.5, 56.6, 56.7, 56.9, 65, 2; 83/499, 516

[56] References Cited

U.S. PATENT DOCUMENTS

| | | | |
|---|---|---|---|
| 1,798,630 | 3/1931 | Robert | 242/56.4 X |
| 2,282,909 | 5/1942 | Thiersch | 242/56.4 |
| 3,086,726 | 4/1963 | Aaron | 242/56.5 |
| 3,583,270 | 6/1971 | Webb | 83/499 |
| 3,883,085 | 5/1975 | Held | 242/56.2 |
| 3,886,833 | 6/1975 | Gunn | 83/499 |
| 3,949,948 | 4/1976 | Tomma | 242/56.9 |
| 3,998,399 | 12/1976 | Held | 242/63 |

*Primary Examiner*—Edward J. McCarthy
*Attorney, Agent, or Firm*—S. W. Gremban

[57] ABSTRACT

A web slitting and winding apparatus having at least a pair of vertical, parallel, plate-like slitter modules slidably movable laterally relative to one another for varying the distance therebetween. Each slitter module further has a pair of flanges extending toward one another for supporting a pair of coacting knives. A web is slit by the knives into a plurality of web strips which are guided and wound onto cores.

18 Claims, 8 Drawing Figures

VARIABLE-WIDTH WEB SLITTING AND WINDING APPARATUS

BACKGROUND OF THE INVENTION

1. Field of the Invention

The present invention relates to a novel variable-width web slitting and winding apparatus. More particularly, the present invention is concerned with a web slitting and winding apparatus having laterally adjustable slitter modules for slitting one or more webs of varying width, and winding the slit web strip(s) onto a receiving core(s).

2. Description of the Prior Art

The prior art is replete with various web slitting and winding machines for winding a plurality of strips slit from a continuous web of paper or the like onto cores.

Representative prior art patents include Webb, U.S. Pat. No. 3,583,270; Held, U.S. Pat. No. 3,883,085; and Held et al, U.S. Pat. No. 3,998,399.

SUMMARY OF THE INVENTION

It is a primary object of the present invention to provide a novel, variable-width web slitting and winding apparatus for cutting a web into a plurality of web strips and winding the strips onto cores.

Briefly, the presently preferred embodiment of a variable-width web slitting and winding apparatus comprises a bed onto which at least a pair of spaced, parallel plate-like slitter modules are slidably mounted. Each slitter module has a pair of flanges extending inwardly toward one another in spaced, parallel relation for rotatably supporting coacting knife blades. A unitary surface-winding drum is mounted laterally offset and parallel to the bed. Core supporting means rotatably support a core adjacent to the drum. Guide means are provided for guiding each slit web strip from the knives partially around the drum and onto the core.

In another aspect of the invention, each slitter module comprises a pair of substantially L-shaped plates. The base legs of the plates are overlapped and secured together to form a substantially U-shaped member having a pair of upwardly extending, spaced legs. The knife supporting flanges extend inwardly from the upwardly extending legs in spaced, parallel relation.

In still another aspect of the invention, means are provided for rotatably mounting knife housings in each flange, and orienting the axes of each pair of complementary knife housings in non-parallel relation so that the coacting knife blades lie in non-parallel planes.

In a further aspect of the invention, means are provided for raising the slitter modules from the bed to facilitate sliding movement of the slitter modules along the bed.

In another aspect of the invention, moving means are provided for imparting slidable movement to selected slitter modules. The moving means comprises a rotatable threaded rod, a nut in each slitter module threadedly mounted on the rod, and means for selectively releasably holding the nuts from rotating.

In still another aspect of the invention, the web slitting and winding apparatus has a single vertically extending frame from which guide rollers, a threaded rod, and knife drive shafts are cantilevered.

One of the advantages of the web slitting and winding apparatus of this invention is its improved simplified, yet rugged design. This results in fewer movable parts, easier accessibility to the assembled parts, and a reduction in the down-time of the apparatus necessary for maintenance and repair.

Another advantage of this invention is the shortening of the time required to (1) adjust the apparatus for varying the width of the slit web strips, (2) unload finished rolls, (3) load cores, and (4) thread the slit web strips onto the cores.

The invention and its advantages will become more apparent from the detailed description of the invention presented below.

BRIEF DESCRIPTION OF THE DRAWINGS

In the detailed description of the invention presented below, reference is made to the accompanying drawings, in which.

DETAILED DESCRIPTION OF THE INVENTION

Figure 1:
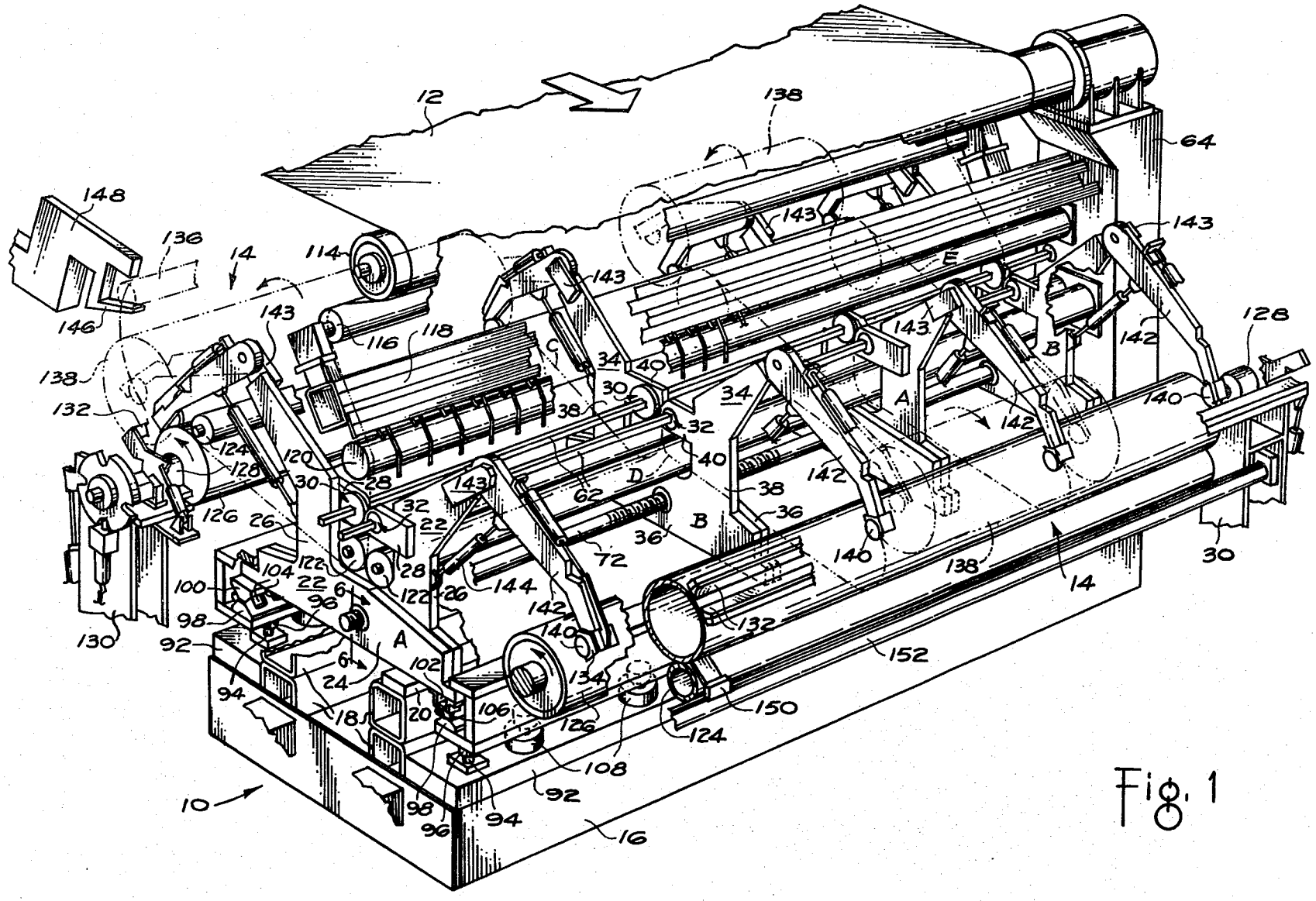
FIG. 1 is a perspective view of a web slitting and winding apparatus with the web shown in phantom, and portions of the apparatus broken away for purposes of clarity.

Referring now to FIG. 1 of the drawings, a web slitting and winding apparatus constructed in accordance with a preferred embodiment of this invention essentially comprises a support bed 10, a plurality of slitter modules designated A and B slidably mounted on the bed for slitting a master web 12 into slit web strips C, D and E of varying width, a slit web strip wind-up section 14 on opposite sides of the slitter modules for winding the slit strips into finished rolls, and drive means for components of the apparatus at one end of the bed.

Figure 7:
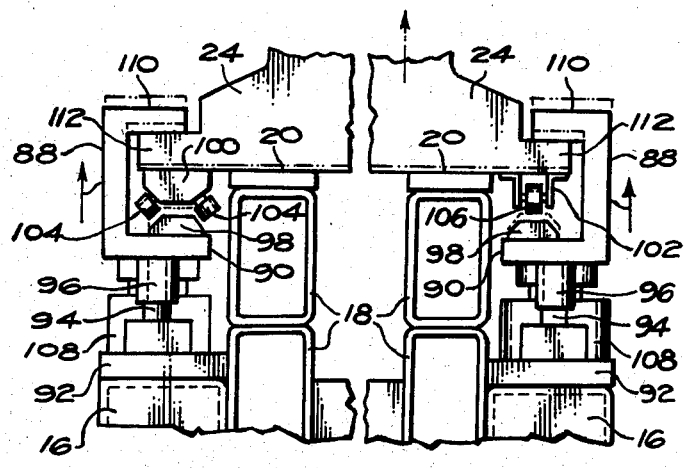
FIG. 7 is an enlarged segmental front elevational view a portion of the apparatus of FIG. 1 showing the means for raising the slitter modules from the bed for sliding movement, other parts of the apparatus being omitted for purposes of clarity.

The support bed 10, as best seen in FIGS. 1 and 7, comprises any suitable rigid base 16 formed from hollow rectangular steel beams or the like mounted on a concrete floor. A plurality of spaced hollow rectangular beams 18 are rigidly secured to the base. Flat steel plates 20 are mounted on the upper surfaces of beams 18 for supporting slitter modules A and B, now to be described.

Each slitter module A comprises a pair of substantially identical L-shaped plates 22, each having a base leg 24 and an upstanding leg 26 having a vertical portion and an outwardly inclined portion. The base legs 24 are overlapped, spaced apart by any suitable spacers, not shown, and secured together with the free ends thereof extending in opposite directions to form a substantially U-shaped module. The upstanding legs 26 have inwardly extending flange plates 28 rigidly secured to face surfaces of the vertical portions of legs 26 in spaced, parallel relation for supporting slitter knife assemblies 30, 32, to be described hereinafter. Each flange plate 28 on one plate 22 is parallel to base leg 24 on the other plate, and cooperates therewith to define a channel therebetween through which an edge of a slit web strip can pass.

Each slitter module B also comprises a pair of substantially identical L-shaped plates 34, each having a base leg 36 and an upstanding leg 38 having a vertical portion and an outwardly inclined portion. The base legs 36 are secured together in a spaced and overlapped relation with the free ends thereof extending in opposite directions to form a substantially U-shaped module. The vertical portions of upstanding legs 38 have integral, inwardly extending flanges 40 in spaced, parallel relation for supporting slitter knife assemblies 30, 32.

Although the slitter modules A, B are shown made from L-shaped plates 22, 34 respectively, each, of course, can also be made out of a solid piece, such as by casting or the like.

Figure 2:
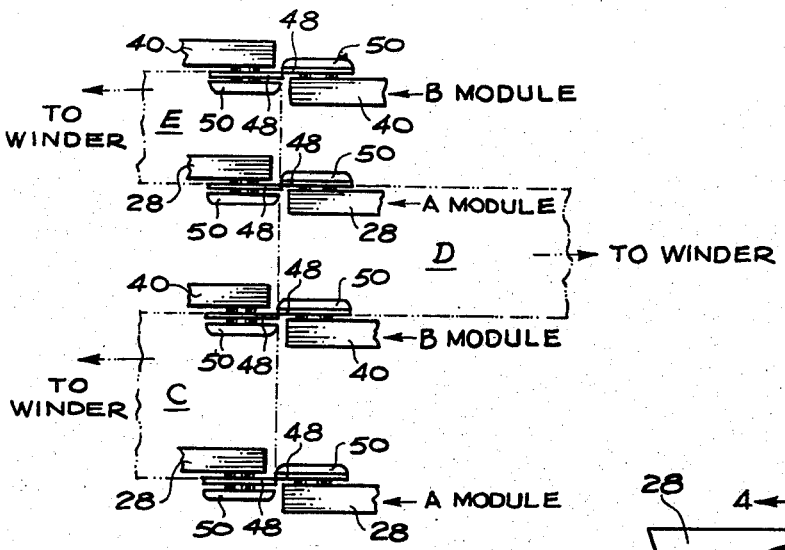
FIG. 2 is a segmental top plan view of the knife assemblies of the apparatus of FIG. 1 for slitting the web into a plurality of strips, shown in phantom, the remaining parts of the apparatus being omitted for purposes of clarity.

Any number of slitter modules A, B, four of which are shown in FIG. 1, are alternately arranged on support bed 10 to provide unobstructed alternate paths for any number of slit web strips, such as strips C, D, E, for example, to the wind-up sections 14, as best seen in FIGS. 1 and 2. The integral knife supporting flanges 40 on the B modules, and offset knife supporting flange plates 28 on the A modules are necessary to allow free passage of the slit web strips in alternate directions.

Figure 3:
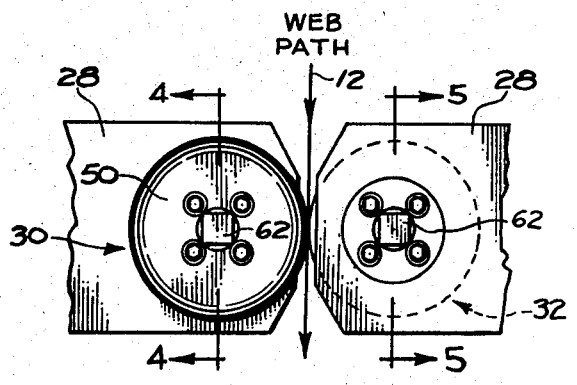
FIG. 3 is a segmental end view of the knife assemblies of FIG. 2.
Figure 4:
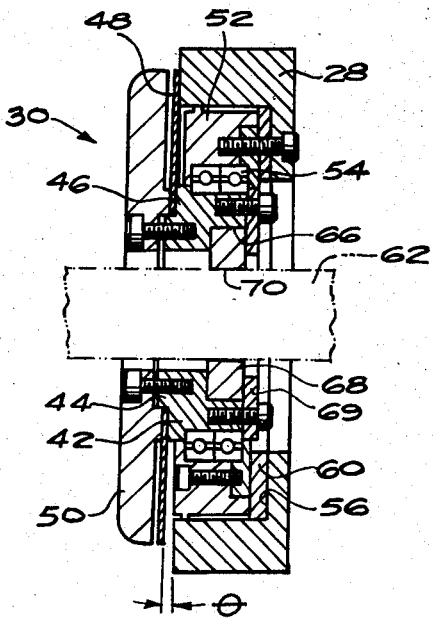
FIG. 4 is a section view of a flexible knife assembly taken substantially along line 4—4 of FIG. 3.
Figure 5:
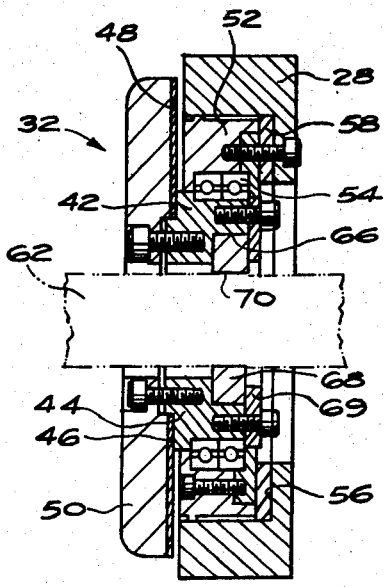
FIG. 5 is a section view of a fixed knife assembly taken substantially along line 5—5 of FIG. 3.

With reference to FIGS. 1–5, one flange 28, 40 of each slitter module A, B respectively rotatably supports a flexible knife assembly 30 (FIG. 4), and the opposite flange 28, 40 supports a fixed knife assembly 32 (FIG. 5). Each knife assembly 30, 32 comprises an inner annular housing 42 having a nose 44 surrounded by an annular seat 46 onto which a circular knife blade 48 is mounted. The knife 48 is retained on seat 46 by an annular retainer plate 50 secured to inner housing 42 by screws. In the flexible knife assembly 30, a space is provided between the inner surface of plate 50 and the rear face of knife blade 48 to allow the blade to flex whereas in the fixed knife assembly 32, the inner surface of plate 50 engages the entire rear face of knife blade 48. Inner housing 42 is rotatably mounted within a bearing housing 52 by bearings 54 interposed between the housings. The bearing housing 52 fits into a blind bore 56 in a flange 28, 40, and is secured to the flange by screws. The axis of flexible knife assembly 30 is adjusted by a tapered shim 60 interposed between bearing housing 52 and flange 28, 40 for tilting the housing and knife blade a degree or so, designated by the angle $\theta$ in FIG. 4, relative to a vertical plane. The axis of fixed knife assembly 32 is adjusted for horizontal orientation by flat shims 58 interposed between bearing housing 52 and flange 28, 40 so that knife blade 48 lies in a vertical plane. The knife assemblies 30, 32 are adjusted by varying the thickness of shims 58, 60 so that the flexibly mounted knife blade 48 bears against the fixedly mounted blade 48 with a predetermined force.

With reference to FIGS. 3–5, the flexible and fixed knife assemblies 30, 32 respectively are rotatably driven by a pair of square shafts 62 cantilevered from an upright frame 64 mounted at one end of support bed 10. The inner housing 42 of each knife assembly 30, 32 has an inner-peripheral, circular groove 66 for receiving a complementary plastic bushing 68. Bushing 68 is rigidly secured to housing 42 by a retainer plate 69. The bushing has an axial square opening 70 through which one of the square drive shafts 62 extends. Rotation of the drive shafts in opposite directions imparts rotation to the bushings 68, inner housings 42 and knife blades 48 in the proper direction for slitting a master web 12 fed between the knife assemblies into one or more web strips, such as web strips C, D and E, for example.

Figure 6:
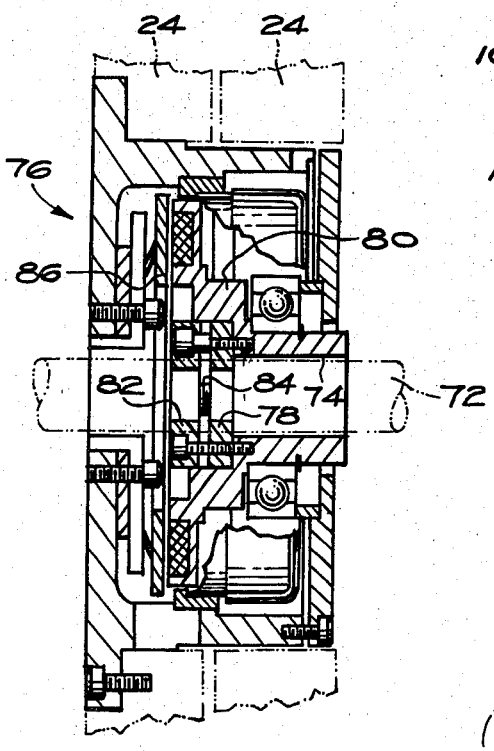
FIG. 6 is a section view taken substantially along line 6—6 of FIG. 1 showing the means for selectively releasing or holding the nut on the rotating threaded rod for slidably adjusting the position of a slitter module.

With reference to FIG. 6, a mechanism is disclosed for adjusting the width of the slit web strips C, D and E by slidably moving slitter modules A, B along bed 10. This mechanism comprises a rotatable drive screw 72 cantilevered from frame 64, and extending through axial openings 74 in aligned clutches 76, one mounted in the overlapped base legs of each of the slitter modules A, B. Each clutch 76 has a fixed half-nut 78 threaded onto screw 72, and secured by screws to a clutch rotor 80 rotatable with the screw and fixed nut 78. The clutch 76 further has a floating half-nut 82 threaded onto the screw, and compression springs 84 interposed between the half-nuts 78, 82 for removing any slack between the screw threads and nuts. When clutch 76 is de-energized, rotation of screw 72 rotates the nuts 78, 82 and clutch rotor 80 freely within the slitter module A, B and no movement is imparted to the slitter module. When clutch 76 is energized, a non rotatable, axially movable coupling plate 86 is moved into braking engagement with clutch rotor 80, and prevents the rotor and nuts 78, 82 from rotating whereby slidable movement is imparted to the slitter module A, B, upon rotation of screw 72. Accordingly, by energizing one or more of the clutches 76, slitter modules containing those clutches will be accurately moved along bed 10 for varying the width of the slit web strips. The actual position of the slitter modules A, B, and knife assemblies 30, 32 can be read by any suitable sensing head, not shown, optically scanning a scale, not shown, spanning the apparatus. The signals from the head are preferably fed to digital displays, not shown, and/or to a computer, not shown, which can control the slit-width adjusting mechanism, as well as one or more of the other mechanisms of which the apparatus is comprised.

To move the slitter modules A, B by rotatable drive screw 72, it is first necessary to lift the slitter modules from bed plates 20. This is achieved by a mechanism now to be described with reference to FIGS. 1 and 7. A U-shaped clamp plate 88 is arranged extending along each side of the slitter modules and bed. One leg 90 of each clamp rail is secured to a bed support plate 92 by telescoping guide posts 94 fixed to plates 92, and sleeves 96 on legs 90 which guide the clamp rails 88 vertically up and down. A guide rail 98 is secured to each leg 90 in alignment with bearing supports 100, 102 secured to opposite bottom side edges of each slitter module A, B. Bearing support 100 has four angularly extending bearings 104 for engaging inclined surfaces of guide rail 98 for laterally positioning each slitter module. The opposite bearing support 102 has a horizontal rotatable roller bearing 106 engaging the top flat surface of the other guide rail 98. A plurality of air cylinders 108 are interposed between and interconnect support plate 92 and leg 90. When actuated, cylinders 108 raise clamp plates 88 and guide rails 98 causing the guide rails to engage the bearings and raise the slitter modules A, B off the bed by approximately 0.005 inches. Such movement also raises opposite legs 110 of clamp plates 88 from laterally extending side lips 112 on the slitter modules. A spring loaded block, not shown, supported by and located between the legs and lips compensates for any unevenness between the two. Each slitter module A, B now rests on bearings 104, 106 and guide rails 98, and can be easily moved by the rotating drive screw 72 to adjust the widths of the slit web strips. When properly adjusted, cylinders 108 are deactivated for lowering the slitter modules A, B onto the bed plates 20, and clamping them thereto. The clamping is achieved by legs 110 of clamp plates 88 forcibly engaging lips 112 on the slitter modules through the springloaded blocks.

Master web 12 is fed by any suitable web feeding means, such as a vacuum drum 114 (FIG. 1) which controls the speed of the web and isolates the rewind tension from the unwind tension. The web 12 proceeds over a tension controlling roller 116, a cutting board 118, and an idler roller 120 into the nip of the knife assemblies 30, 32. The web 12 is slit into a plurality of slit web strips C, D, E, each of which is guided around one of two idler rollers 122, and into slit web strip wind-up sections 14 provided on opposite sides of the slitter modules and bed. The idler rollers 122 extend through openings in the slitter modules A, B defined by the base legs 24, 36, upstanding legs 26, 38 and flanges 28, 40, and are mounted for rotation on support shafts, not shown, cantilevered from vertically extending frame 64. The slit web strips are guided from the knife assemblies 30, 32 in staggered relation, as best seen in FIGS. 1 and 2, into the slit web strip wind-up sections 14, now to be described.

Figure 8:
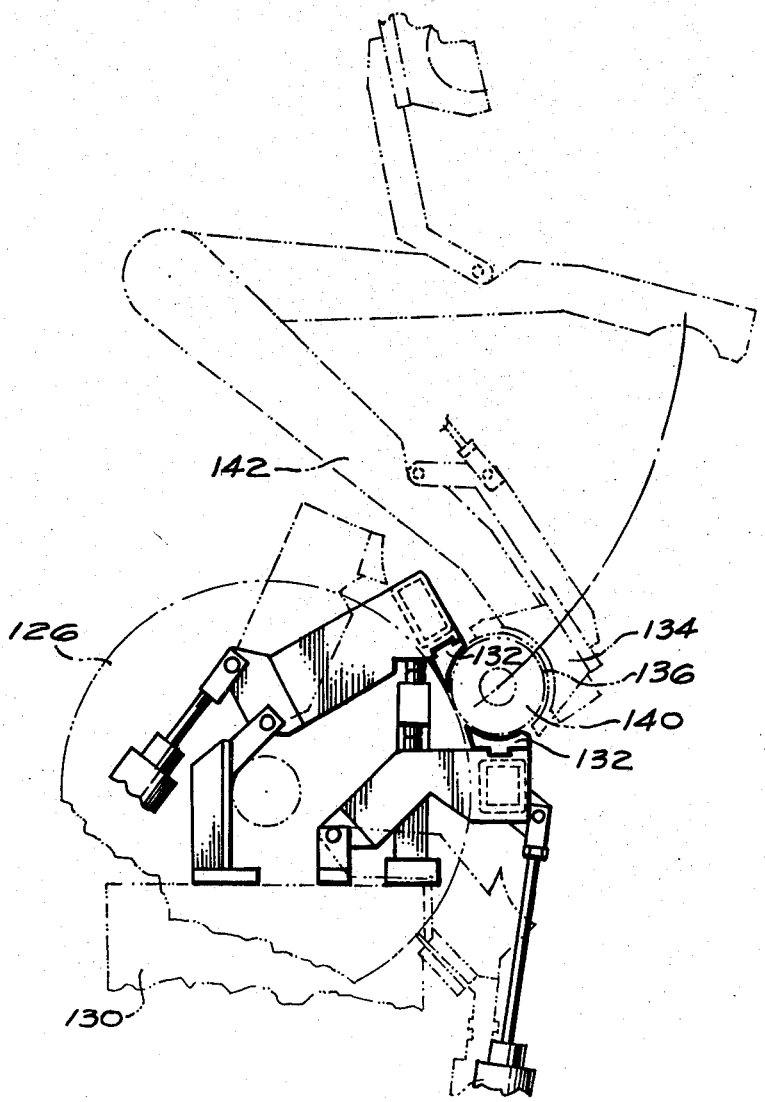
FIG. 8 is a segmental front right side elevational view of a portion of the apparatus of FIG. 1 showing, in full lines, one of the mechanisms for guiding a web strip around a core, and the remaining portion of the apparatus omitted or in phantom for purposes of clarity.

Since the wind-up sections 14 for the slit web strips C, D, E are substantially identical except for the fact that strips C and E are threaded over a driven surface winding drum 126, and the other strip D is threaded underneath the drum, only the strip D wind-up section will be explained in detail. Slit web strip D is guided by guide chutes (not shown) and an idler pressure roller 124 partially around surface winding drum 126 extending across the entire machine. Drum 126 has stub shafts, not shown, at each end thereof rotatably mounted in support brackets 128 (FIG. 1), only two of which are shown secured to support columns 30. Drum 126 is rotatably driven by any suitable drive motor, not shown, coupled thereto by any suitable belt or gear train, not shown. The slit web strip end is guided onto and cinched to a core 136 by pivotally mounted cylinder operated cinch bars 132 and shoes 134 (FIG. 8). The slit web strip is initially center wound onto the core, and then surface wound by the surface winding drum 126 to form a finished roll 138.

The ends of the cores 136 are supported by cylinder operated gudgeons 140 (FIG. 8) rotatably mounted at the free ends of a pair of spaced wind-up arms 142. The opposite ends of arms 142 (FIG. 1) are pivotally secured to brackets 143 mounted on the free ends of the inclined portions of upstanding legs 26, 38 of the slitter modules A, B. Accordingly, adjustment of the slitter modules to vary the width of the slit strips automatically adjusts arms 142 and the gudgeons supported thereby to the proper core length. A cylinder 144 is provided between each arm 142 and the edge of the vertical portion of a slitter module leg 26, 38 for moving the arms between an extended core loading position, in which a core 136 of a length matching the width of a slit strip can be loaded on gudgeons 140, and a retracted roll winding position, in which the gudgeons are moved into engagement with the surface of surface winding drum 126.

During the core loading operation, wind-up arms 142 are raised by cylinders 144 until the gudgeons 140 are in line with the cores 136 lying in nests 146 of a core feed tray 148 (FIG. 1). The cylinder operated gudgeons 140 are axially moved inwardly to engage the core ends. The nests 146 are retracted by means, not shown, and the arms 142 together with the cores held in the gudgeons 140 are lowered until the gudgeons contact the winding drums 126, as seen in FIG. 8. The cores 136 are smaller in diameter than the gudgeons 140 to allow the slit web strip to pass between drum 126 and the core during thread-up. The upper guide 132 skims the end of the slit strip from the drum and feeds it around the core. The cylinder operated shoe 134 is moved to straddle the core and continues to guide the strip around the core. The lower guide shoe 132 completes the guiding of the strip end around the core and tucks it into the nip between the succeeding strip convolution and core. The core is driven by any suitable means, not shown, to run faster than the web, and since the shoe 134 also contains a roller, not shown, which presses the web against the core, the slit web strip is tightened around the core and cinched. A few laps are wound onto the core in center wind mode to form a roll 138. As the outer periphery of roll 138 makes contact with winding drum 126, the center drive to the core becomes ineffective and the roll continues to be wound by the winding drum in a surface driving mode of operation. When roll 138 has been wound to the desired diameter, the machine is stopped and the pressure roll 124 is pressed against the winding drum 126 to pinch the slit web strips. The "end of a roll" knife 150 is moved by a rodless air cylinder 152 across all of the strips to cut them off. The gudgeons 140 are then retracted and the finished rolls 138 are unloaded onto a suitable roll unloading device, not shown. The next cycle of core loading, cinching and winding is initiated, and the above-described sequence repeated.

As indicated earlier, slitter drive shafts 62, slitter module drive screw 72, and idler rollers 120, 124 are all cantilevered from upright frame 64 to extend forwardly over support bed 10. The shafts, and screw have portions thereof, not shown, journaled for rotation within the frame, and rearwardly extending portions, not shown, coupled by any suitable means, such as gears, pulleys and belts, not shown, to any suitable drive motors, not shown, for rotatably driving the drive shafts 62, and drive screw 72.

While a presently preferred embodiment of the invention has been shown and described with particularity, it will be appreciated that various changes and modifications may suggest themselves to one having ordinary skill in the art upon being apprised of the present invention. It is intended to encompass all such changes and modifications as fall within the scope and spirit of the appended claims.

What is claimed is:

1. A variable-width web slitting and winding apparatus comprising:

a longitudinally extending bed;

at least a pair of longitudinally spaced, parallel, and unitary plate-like slitter modules extending upwardly from and slidably mounted on said bed relative to one another, each slitter module having a pair of rigid flanges extending inwardly toward one another in parallel spaced relation;

knife means rotatably mounted on each pair of said flanges of each slitter module for slitting a web fed through said knife means;

means coupled to said slitter modules for slidably adjusting said modules on said bed for varying the distance between said pair of slitter modules and knife means and hence the width of a first strip slit by said knife means;

a drivable first unitary winding drum parallel to said bed and laterally offset from one side of said pair of slitter modules;

first core supporting means on said slitter modules for rotatably supporting a first core and positioning the first core adjacent to said first drum; and first guiding means for guiding the first slit strip between the first core and said first drum and onto the first core whereby the first slit strip is wound by said first drum onto the first core.

2. A variable-width web slitting and winding apparatus comprising:

a bed;

at least a pair of spaced parallel, plate-like slitter modules laterally extending from and slidably mounted on said bed relative to one another, each slitter module comprising a pair of substantially L-shaped plates secured together to form a substantially U-shaped member having a pair of upwardly extending spaced legs, said legs having a pair of rigid flanges extending inwardly toward one another in parallel spaced relation;

knife means rotatably mounted on each pair of said flanges for slitting a web fed through said knife means;

means coupled to said slitter modules for slidably adjusting said modules on said bed for varying the distance between said knife means and hence the width of a first strip slit by said knife means;

a drivable first unitary winding drum parallel to said bed and laterally offset from one side of said pair of slitter modules;

first core supporting means on said slitter modules for rotatably supporting a first core and positioning the first core adjacent to said first drum; and first guiding means for guiding the first slit strip between the first core and said first drum and onto the first core whereby the first slit strip is wound by said first drum onto the first core.

3. A variable-width web slitting and winding apparatus according to claim 2 wherein said U shaped member has a pair of overlapped base legs.

4. A variable-width web slitting and winding apparatus according to claim 3 wherein each of said knife means comprises a pair of knife housings, a pair of coacting circular slitting knives mounted on said knife housings in which each knife housing is rotatably supported by one of said flanges on each of said upwardly extending legs.

5. A variable-width web slitting and winding apparatus according to claim 4 wherein said pairs of knife housings in said slitter modules are aligned to define a pair of spaced, axially aligned openings, said apparatus further having a pair of drive shafts extending through said spaced axial knife housing openings for rotatably driving said knives, said knife housings further being axially movable on said drive shafts as said slitter modules are slidably movable on said bed.

6. A variable-width web slitting and winding apparatus according to claim 5 wherein each of said knife housings has an axis of rotation, and means are provided for orienting the axis of at least one of said knife housings of each pair of knife housings relative to the other of said knife housings whereby said coacting knives do not lie in the same plane.

7. A variable-width web slitting and winding apparatus according to claim 6 wherein said knife housing openings are slightly larger than the outer periphery of said drive shafts to allow slight pivotal movement of said knife housings thereon, and said knife housing axis orienting means comprises a knife housing suppport block, a bearing interposed between said knife housing and said support block, and a tapered shim interposed between said support block and said flange on each leg for orienting the axis of said knife housing relative to the axis of said drive shaft.

8. A variable-width web slitting and winding apparatus according to claim 2 wherein said means for slidably adjusting said slitter modules comprises aligned openings in said slitter modules, a rotatable nut contained within each module opening and having a threaded nut opening aligned with said slitter module openings, a threaded rod insertable through said openings in said slitter module and in threaded engagement with said threaded openings in said nuts, means for rotating said threaded rod, and means for selectively releasably holding said nuts from rotation whereby upon rotation of said threaded rod slidable movement is imparted to the selected slitter modules whose nuts are held from rotating.

9. A variable-width web slitting and winding apparatus according to claim 2, and further comprising means movable between a first position for clamping said slitter modules to said bed, and a second position for raising said slitter modules from said bed for facilitating slidable movement of said slitter modules along said bed.

10. A variable-width web slitting and winding apparatus according to claim 9 wherein each of said slitter modules has a lip along each side thereof, and said clamping and raising means comprises a pair of spaced, parallel first guide rails on said slitter modules, a pair of spaced, parallel second guide rails below and in register with said pair of first guide rails, and extending along the length of said bed, bearings interposed between said pair of first and second guide rails, a pair of spaced, parallel clamp rails, each rail having a first leg adjacent one of said lips and a second leg for supporting one of said second guide rails, and cylinder means secured to each of said clamp rails for moving said clamping and raising means between said first position for clamping said first legs to said respective lips and said slitter modules to said bed, and said second position for forcing said second guide rails against said bearings for raising said first guide rails and slitter modules from said bed to facilitate movement of said slitter modules on said second guide rails.

11. A variable-width web slitting and winding apparatus according to claim 2 wherein two outer slitter modules and one inner slitter module are provided, each module having said knife means for slitting a web into adjacent first and second strips, a second driven winding drum is provided parallel to said first drum and laterally offset from the opposite side of said slitter modules, said first core supporting means comprises a first core support member pivotally secured to said one side of one of said outer slitter modules and said inner slitter module for rotatably supporting the first core to receive the first strip, second core supporting means comprising a second core support member pivotally secured to said opposite side of the other of said outer slitter modules and said inner slitter module for rotatably supporting a second core in position to receive the second strip, and second guiding means are provided for guiding the second strip between the second core and second drum onto the second core whereby the second slit strip is wound by said second drum onto the second core.

12. A variable-width web slitting and winding apparatus according to claim 2 wherein two outer slitter modules and one inner slitter module are provided, each having said knife means for slitting adjacent first and second strips, each of said knife means comprises a pair of coacting circular slitting knives in which each knife is rotatably supported by one of said flanges on each of said legs, a second driven winding drum is provided parallel to said first drum and laterally offset from the opposite side of said slitter modules and said inner slitter module, said first core supporting means comprises a first core support member pivotally secured to said one side of one of said outer slitter modules and said inner slitter module for rotatably supporting the first core to receive the first strip, second core supporting means comprising a second core support member pivotally secured to said opposite side of the other of said outer slitter modules and said inner slitter module for rotatably supporting a second core in position to receive the second web, and second guiding means are provided for guiding the second web between the second core and second drum and onto the second core whereby the second slit strip is wound by said second drum onto the second core.

13. A variable-width web slitting and winding apparatus according to claim 12 wherein said pairs of knives have axially aligned spaced openings, said apparatus further having a vertically extending frame and a pair of drive shafts cantilevered from said frame and extending through said spaced knife openings for rotatably driving said knives, said knives further being axially movable on said drive shafts as said slitter modules are slidably movable on said bed.

14. A variable-width web slitting and winding apparatus according to claim 12 wherein said means for slidably adjusting said slitter modules comprises aligned openings in said slitter modules, said apparatus further having a vertically extending frame and a rotatably mounted threaded rod cantilevered from said frame and extending through said openings in said slitter modules, a threaded nut contained within each slitter module opening in threaded engagement with said rod, means for rotating said threaded rod, and means for selectively releasably holding said nuts from rotation whereby upon rotation of said threaded rod slidable movement is imparted to the selected slitter modules whose nuts are held from rotating.

15. A variable-width web slitting and winding apparatus according to claim 12, and further comprising means movable between a first position for clamping said slitter modules to said bed, and a second position for raising said slitter modules from said bed for facilitating slidable movement of said slitter modules along said bed.

16. A variable-width web slitting and winding apparatus according to claim 15 wherein each of said slitter modules has a lip along each side thereof, and said clamping and raising means comprises a pair of spaced, parallel first guide rails on said slitter modules, a pair of spaced, parallel second guide rails below and in register with said pair of first guide rails and extending along the length of said bed, bearings interposed between said pairs of first and second guide rails, a pair of spaced, parallel clamp rails, each rail having a first leg adjacent one of said lips and a second leg for supporting one of said second guide rails, and cylinder means secured to each of said clamp rails for moving said clamping and raising means between said first position for clamping said first legs to said respective lips and said slitter modules to said bed, and said second position for orcing said second guide rails against said bearings for raising said first guide rails and slitter modules from said bed to facilitate movement of said slitter modules on sid second guide rails.

17. A variable-width web slitting and winding apparatus according to claim 12, and further comprising a pair of web guide rollers interposed between said knife means and said first and second winding drums and extendable through the space defined by said legs and said flanges of said slitter modules with the nip of said guide rollers substantially in register with the nip of said knife means.

18. A variable-width web slitting and winding apparatus according to claim 17 wherein said apparatus has a vertically extending frame at one end of said bed, and said guide rollers are cantilevered from said frame.

* * * * *